US008713836B1

(12) United States Patent
Haq

(10) Patent No.: US 8,713,836 B1
(45) Date of Patent: May 6, 2014

(54) AUTOMATIC TRIGGER GUARD FOR FIREARMS

(71) Applicant: Ataul Haq, Port St. Lucie, FL (US)

(72) Inventor: Ataul Haq, Port St. Lucie, FL (US)

( * ) Notice: Subject to any disclaimer, the term of this patent is extended or adjusted under 35 U.S.C. 154(b) by 0 days.

(21) Appl. No.: 13/680,056

(22) Filed: Nov. 17, 2012

(51) Int. Cl.
*F41A 17/54* (2006.01)

(52) U.S. Cl.
CPC ..... *F41A 17/54* (2013.01)
USPC ..... 42/70.06

(58) Field of Classification Search
CPC ..... F41A 17/54
USPC ..... 42/70.06, 70.07, 70.01
See application file for complete search history.

(56) References Cited

U.S. PATENT DOCUMENTS 2,080,202 A * 5/1937 Drake ..... 42/70.07
2,525,886 A * 10/1950 Fraser ..... 42/70.03
2,709,865 A * 6/1955 Bohenek ..... 42/70.06
3,020,663 A * 2/1962 Newson ..... 42/70.06
3,269,046 A * 8/1966 Schaefer ..... 42/70.06
4,422,254 A * 12/1983 McQueen ..... 42/70.07
5,075,994 A * 12/1991 Nishioka ..... 42/70.07
6,253,480 B1 * 7/2001 Florez ..... 42/70.11
2002/0174587 A1 * 11/2002 Rumfelt ..... 42/70.07

* cited by examiner

*Primary Examiner* — Reginald Tillman, Jr.

(57) ABSTRACT

A retrofit able Trigger Guard assembly is the invented embodiment, which is attached permanently to an existing firearm or can be integrated to any firearm during manufacturing. This assembly is attached permanently under the muzzle of any firearm, typically a hand gun. In general, the invented mechanism operates under the force of gravity and certain relevant lever action extends guard plates on both side of the trigger assembly, thereby making it in operable. The guard plates are extended over the trigger guard of the firearm as soon as the gun is pointed downward. This mechanism is locked inside the assembly by an electrical miniature solenoid, which release the lock in order to facilitate the retraction only if the firearm is leveled and the bio metrics of the user matches the pre stored finger prints in the memory of the assembly, therefore, only authorized user can activate the trigger.

3 Claims, 2 Drawing Sheets

AUTOMATIC TRIGGER GUARD FOR FIREARMS

CROSS-REFERENCE TO RELATED APPLICATIONS

US & International Patents Documents
EP0928407A1 Frank Brooks
EP2265884B1
EP1171746B1
U.S. Pat. No. 5,461,812
U.S. Pat. No. 4,488,370
EP1463915a1
US 2004/0192473 A1
Field of Classification Search
42/70.06, 70.11, 42/84
U.S. Classification
42/70.11, 42/70.06
Int. Cl.
F41A 17/02, 17/38, 17/36, 17/04, 17/44, 17/06, 17/00

STATEMENT REGARDING FEDERALLY SPONSORED RESEARCH OR DEVELOPMENT

"Not Applicable"

BACKGROUND OF THE INVENTION

1. Field of the Invention

This invention relates to a safety mechanism especially for Handguns trigger mechanism in order to prevent accidental discharge during draw from the holster generally in panic situation and an unauthorized use during a conflict situation where the handgun could be used by over powering the authorized user or an officer. This invention uses a very simple retrofit able gravity actuated lever mechanism. When the handgun is pointed downward or as placed in the holster, a lever mechanism is actuated and in turn moves plate guards over the trigger on both sides thereby preventing the finger to actuate the trigger. Once the guard is in place over the trigger a locking mechanism may be employed which can only be released in the case that the bio metrics of the index finger of the authorized user is matched. However, as soon as the hand gun is leveled and the bio metrics are matched the trigger guard retracts to the normal position; thereby the hand gun can be operated as essentially needed. A simple retrofit able version without bio metrics can operate the lever mechanism without a lock, thereby preventing the accidental discharge while drawing the handgun from the holster. However, as soon as the gun is leveled the trigger guards retract and hand gun can be used as intended.

This simple mechanical and electronic configuration can be easily attached to any existing handgun in front of standard trigger guard under the barrel of such handgun. In bio metric version, a micro processor is placed in the same assembly with a small bio metric reader. This bio metric reader is placed in such a way that it can read the index fingers bio metrics and turn off the locking mechanism, which locks the lever in safe mode as soon as the gun is lowered down or placed down in the holster.

2. Description of Related Art, Including Informational Disclosure Under CFR 1.97 and CFR 1.98

BRIEF SUMMARY OF THE INVENTION

This invention pertains to a retrofit able safety mechanism for handguns and other firearm from accidental discharge and unauthorized use. The mechanism involves a simple gravity actuated lever and plates (guard) mechanism. This mechanism can be installed in any existing handgun or firearm. This safety device, when installed, will prevent accidental discharge and unauthorized use of such hand gun and firearm. This invented device operates using natural force of gravity (and nominal battery power in advance version), in such a way that as soon as the handgun or firearm is lowered or put in holster, the system actuates the weighted pendulum which pushes two thin steel (or similar hard material) plates over the trigger of the handgun, thereby making it inoperable. These plates (guards) are extended out of this retrofit able assembly on to over the trigger of the firearm and lock itself onto certain position. This mechanism can be enhanced by providing a bio metric reader for index finger print to match with already stored prints in the micro chip. Upon a match the lock release itself and the levers are retracted automatically as soon as the handgun is leveled.

This invention will prevent sudden discharge of a firearm, especially during a draw from the holster in panic conditions. And such mechanism with enhanced bio metric version will prevent unauthorized use, especially during a situation where over powering of the gun owner or law enforcing officer.

The enhanced version comprises of a bio metric reader placed on either side of the retrofit able invented unit. A micro CPU and reader circuit is loaded with saved bio metric prints of the authorized user. The finger prints are saved into permanent memory of chip/bios, which is performed with a USB port provided on this retrofit able assembly and software that can be down loaded on to any compute. This retrofit able safety device is also provided with colored LED indicators for low battery signal, fire mode signal and safe/lock mode signal.

DETAIL DESCRIPTION OF THE INVENTION

Figure 1:
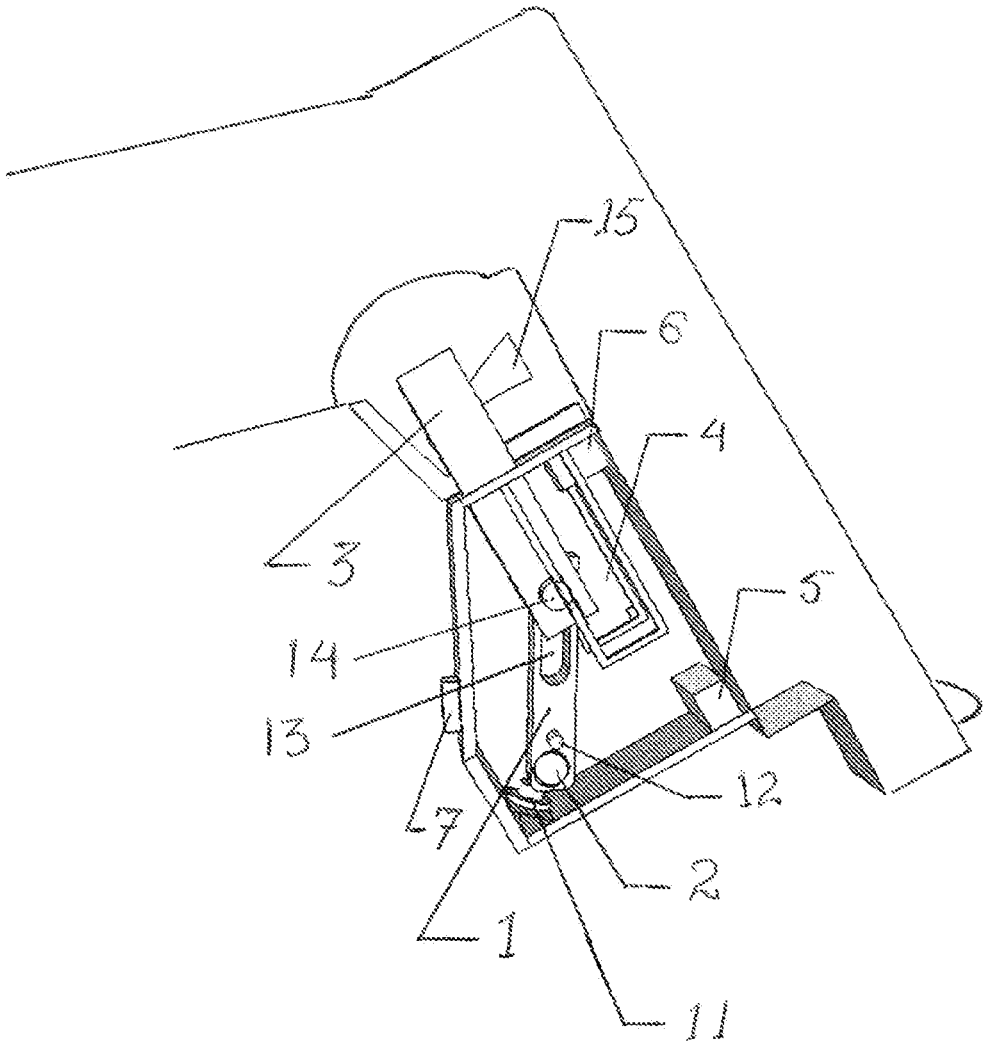
FIG. 1 is an open view of the invented embodiment affixed permanently to a handgun, pointing down or placed in a holster. Casing 10 houses a mechanism which comprises of weighted lever 1 which has a dead weight 2, fused at its lower point. This lever 2 has a fulcrum point 12 and an elongated slot 13. Two guard plates 3 pined together with a floating pin 14 placed through the slot 13 at both end in such a way that movement of lever 1 on its fulcrum point 12 causes the plates 13 to move through a set of guide over the trigger 15 of the handgun. The lever 1 locks at its lowest point by a spring loaded solenoid switch 11 and the LED indicator 9 turn green to indicate that the gun is in safe mode, that is, it is operable. The bio metric finger point reader 4 reads the index finger print of the user of the handgun, and in case the finger print matches with the existing data base stored in the bios, solenoid releases the lock and as soon as the gun is about leveled the guard plates 3 retracts to unsafe position thereby turning the LED indicator red therefore the firearm can be used.

A fabricated or otherwise manufactured self contained assembly is shown in FIG. 1, of certain physical characteristics such as width, breaking strength, weight etc. This assembly is attached permanently under the muzzle of any firearm, typically a hand gun in such a manner that it functions properly in order to provide safety mechanism by shielding the trigger of the gun. In general, the invented mechanism operates under the force of gravity and relevant lever action to extend guard plates on both side of the trigger thereby making it in operable. The guard plates are extended over the trigger guard of the firearm as soon as the gun is pointed downward. This action is performed by certain free weight and appropriate lever action. The guard plates are made of flexible hard material like stainless steel having high tensile and breaking strength. These plates are locked into receiving sockets provided at certain position on the existing trigger guard of the firearm. However, these guard plates retracts as soon as the handgun is about leveled.

In advance version of this invention, the mechanism is locked inside the assembly by an electrical miniature solenoid, which release the lock in order to facilitate the retraction only if the firearm is leveled and the bio metrics of the user matches the pre stored finger prints in the memory of the assembly, therefore, only authorized user can activate the trigger. The finer print of the authorized user (owner of the gun) is pre stored in the memory using a USB port that is provided on the invented assembly. Any computer can be down loaded with the certain software to facilitate such programming, which is stored into the bios provided in the assembly.

FIG. 1 is showing the firearm pointing downward, such as placed in the holster. The guard plates are automatically extended and locked in that position by certain mechanical and electrical system, thereby, making the trigger in operable. This prevents the accidental discharge of a firearm, especially during a panic situation and sudden draw from the holster. Also, this assembly deters the unauthorized use, especially in case of scuffle and over powering and snatching the firearm from its authorized user.

Figure 2:
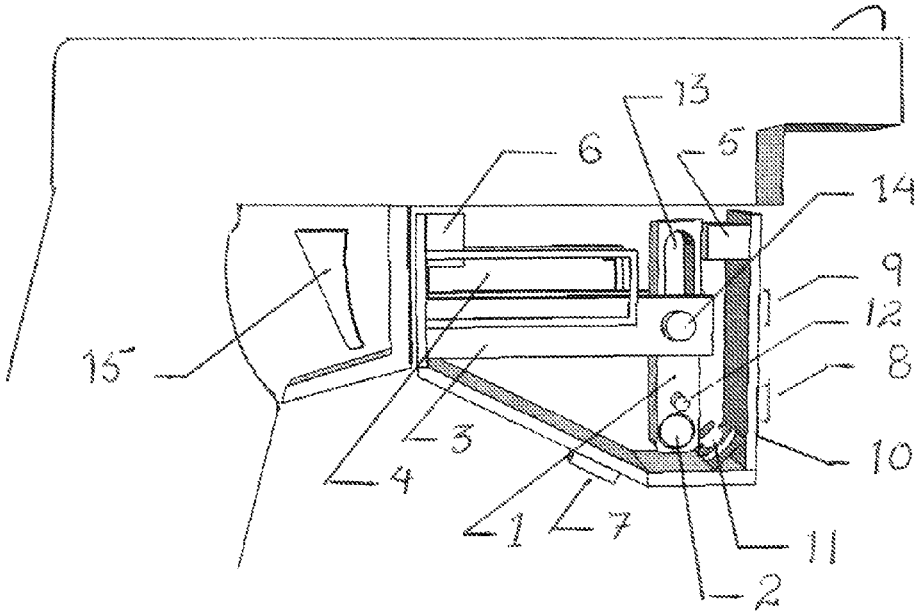
FIG. 2 is an open view of the invented embodiment affixed permanently to a handgun pointing about at level. The LED indicator 9 turned RED indicating firing mode. A USB port 7 is provided for pre storing finger prints of authorized users, by connecting to a computer. LED indicator 8 blinks yellow when battery 5 is below a certain level. The bio metric reader 4 is wired to the CPU 6 which contains necessary program and data. The assembly 10 is a complete self contained unit of strong light weight material, which is permanently affixed to any hand gun with special set screws or other affixing means under the handgun barrel next to the existing trigger guard.

FIG. 2 is shown where the gun is leveled and the guard plates are retracted. The assembly is provided with colored LED light in order to indicate; Firing Mode, Safe Mode and Low Battery Mode.

The disclosed embodiment of the apparatus, system and method according to the invention are illustrative of the scope of the invention, which is recited in the following claims. Various modifications of the disclosed embodiments can be made or are apparent from the description contained herein, without departing from the scope of the invention is claimed.

The invention claimed is:

1. A firearm trigger guard system for a firearm having a trigger and a trigger guard, the trigger guard system including:

a casing having a front end and a back end, the casing configured to attach under the muzzle of the firearm in front of the trigger guard, the casing having an opening in the back end;

a pair of retractable plates configured to move between a first position wherein the plates are located inside the casing and a second, extended position where each plate extends through the opening in the rear end of the casing, the plates arranged such that there is a space between the plates for receiving the trigger; and a means for moving, wherein as the front end of the trigger guard system is pointed towards the ground the means for moving automatically moves the plates from the first position to the second position to prevent actuation of the trigger, and as the system is leveled, the means for moving automatically moves the plates from the second position to the first position.

2. The trigger system of claim 1 further comprising a locking mechanism to lock the plates in the second position.

3. The trigger guard system of claim 2 further comprising a memory configured to store biometric data of at least one user and a biometric sensor, wherein upon the match of data between the memory and the sensor, the locking mechanism is released.

* * * * *